US008425346B1

(12) United States Patent
Erickson

(10) Patent No.: US 8,425,346 B1
(45) **Date of Patent: *Apr. 23, 2013**

(54) WEIGHTED GOLF CLUB HEAD

(71) Applicant: Callaway Golf Company, Carlsbad, CA (US)

(72) Inventor: Joel B. Erickson, Pierce, NE (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/751,447

(22) Filed: Jan. 28, 2013

Related U.S. Application Data

(63) Continuation of application No. 13/667,692, filed on Nov. 2, 2012, which is a continuation of application No. 13/559,279, filed on Jul. 26, 2012, now Pat. No. 8,328,661, which is a continuation of application No. 13/475,497, filed on May 18, 2012, now Pat. No. 8,257,195.

(60) Provisional application No. 61/635,363, filed on Apr. 19, 2012.

(51) Int. Cl.
*A63B 53/04* (2006.01)

(52) U.S. Cl.
USPC ..... 473/329; 473/335; 473/345; 473/346; 473/349

(58) Field of Classification Search ..... 473/324–350, 473/287–292
See application file for complete search history.

(56) References Cited

U.S. PATENT DOCUMENTS 8,257,195 B1 * 9/2012 Erickson ..... 473/329
8,328,661 B1 * 12/2012 Erickson ..... 473/329

* cited by examiner

*Primary Examiner* — Sebastiano Passaniti
(74) *Attorney, Agent, or Firm* — Rebecca Hanovice; Michael A. Catania; Sonia Lari

(57) ABSTRACT

A golf club head having a center of gravity located at a point close to the face and the sole is disclosed herein. In particular, the golf club head comprises a hollow body including a weight lip and face component, and the weight lip extends from the sole inside the body into the face component. The golf club head is preferably a wood-type or hybrid-type golf club head.

20 Claims, 2 Drawing Sheets

WEIGHTED GOLF CLUB HEAD

CROSS REFERENCES TO RELATED APPLICATIONS

The present application is a continuation of U.S. patent application Ser. No. 13/667,692, filed on Nov. 2, 2012, which is a continuation of U.S. patent application Ser. No. 13/559,279, filed on Jul. 26, 2012, which issued on Dec. 11, 2012, as U.S. Pat. No. 8,328,661, which is a continuation of U.S. patent application Ser. No. 13/475,497, filed on May 18, 2012, which issued on Sep. 4, 2012, as U.S. Pat. No. 8,257,195, which claims priority to U.S. Provisional Patent Application No. 61/635,363, filed on Apr. 19, 2012, the disclosure of each which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having internal weighting that locates the center of gravity of the golf club head close to the face and sole.

2. Description of the Related Art

Golfers often prefer to use golf clubs having low centers of gravity that are also close to the face, which allows for greater control over golf balls during play. There is a need for golf club heads having improved internal weighting.

BRIEF SUMMARY OF THE INVENTION

One aspect of the present invention is a golf club head comprising a body comprising a crown, a sole, a cavity, and a protrusion, and a face component, wherein the protrusion is located within the cavity and extends from the sole towards the face component. The golf club head may be selected from the group consisting of a wood-type head, a hybrid-type head, and an iron-type head, and in some embodiments may be a fairway wood head. The body of the head may be cast or forged from a metal material, such as titanium alloy or stainless steel. In some embodiments, the face component comprises a striking face and a return portion. The face component may be forged from a metal material, such as titanium alloy and stainless steel. In some embodiments, the body and the face component may be integrally formed.

Another aspect of the present invention is wood-type golf club head comprising a metal body comprising a crown, a sole, a hosel, a cavity, a frontal opening, and a protrusion, and a metal face component comprising a striking face and a return portion, wherein the striking face and return portion form a face component cavity, wherein the face component covers the frontal opening, wherein the protrusion is located within the cavity proximate the frontal opening and extends upwards from the sole into the face component cavity without touching the striking face, wherein the golf club head has a mass of no less than 180 grams and no more than 215 grams, and wherein the golf club head a volume of no less than 120 cubic centimeters and no more than 470 cubic centimeters. In some embodiments, the protrusion may comprise hollow portions, while in other embodiments the protrusion is solid and does not comprise any hollow portions.

Yet another aspect of the present invention is a wood-type golf club head comprising a metal body comprising a crown, a sole, a cavity, and a protrusion, and a metal face component comprising a striking face and a return portion, wherein the striking face and the return portion form a face component cavity, wherein the protrusion is located within the cavity and extends into the face component cavity without touching the striking face, wherein the body is integrally cast, and wherein the face component is integrally forged. The protrusion may comprise at least 20% of the mass of the body, and in some embodiments may comprise approximately 30% of the mass of the body. In some embodiments, the protrusion may extend from the sole. The golf club head may have a mass of no less than 180 grams and no more than 215 grams, and may have a volume of no less than 120 cubic centimeters and no more than 500 cubic centimeters.

Another aspect of the present invention is a fairway wood-type golf club head comprising a stainless steel body comprising a crown, a sole, a cavity, a hosel, and a protrusion, and a stainless steel face component comprising a striking face and a return portion, wherein the striking face and the return portion form a face component cavity, wherein the protrusion is located within the cavity and extends from the sole into the face component cavity without touching the striking face, wherein the body is integrally cast, wherein the face component is integrally forged, and wherein the golf club head has a mass of no less than 180 grams and no more than 215 grams. The face component may be affixed to the body by any means known in the art, and in some embodiments the face component is welded to the body. The fairway wood-type golf club head may further comprise a weight pad, which in some embodiments may be affixed to the sole.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is generally directed to a golf club head having internal weighting that places the golf club center of gravity (CG) at a point near both the face and the sole of the golf club head. In particular, the present invention is directed to integrally formed weighting in smaller golf club heads, particularly fairway woods and hybrids.

Figure 1:
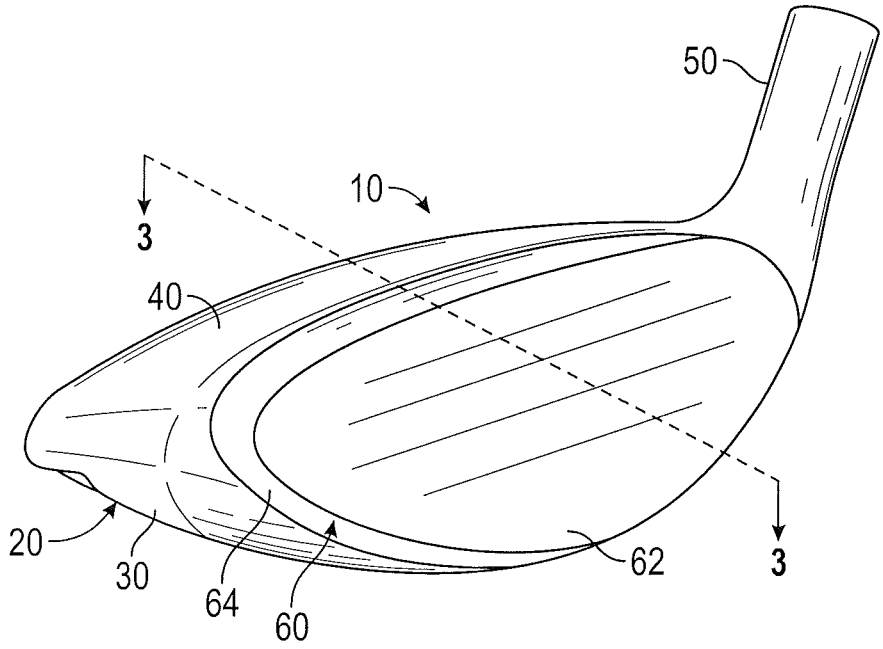
FIG. 1 is top perspective view of an embodiment of the present invention.
Figure 2:
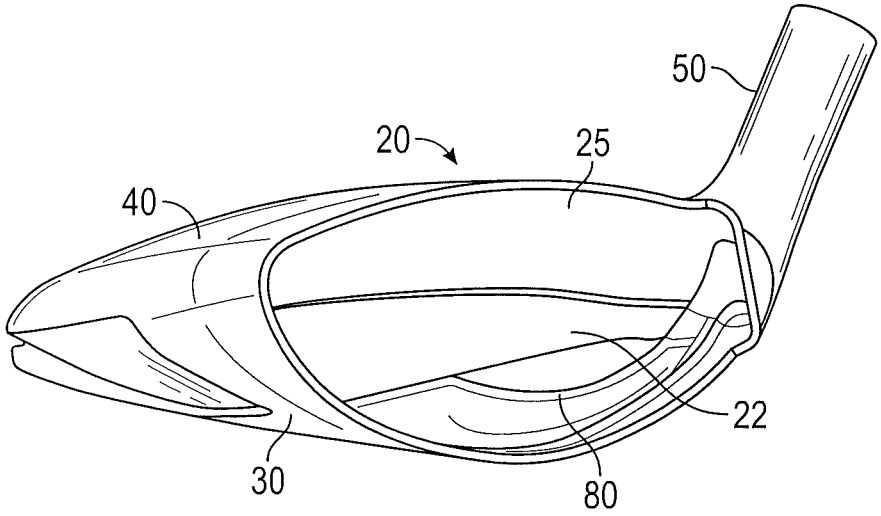
FIG. 2 is front perspective view of the embodiment shown in FIG. 1 without the face component.
Figure 3:
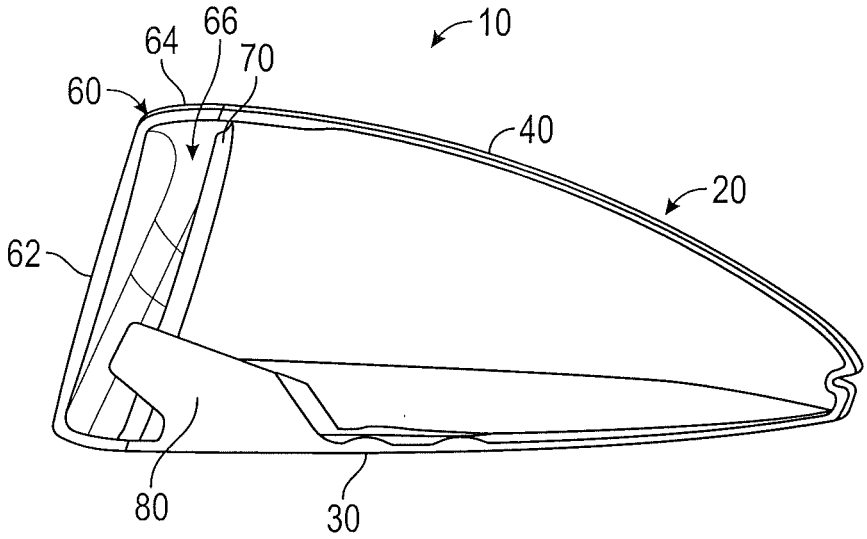
FIG. 3 is a cross-sectional view of the embodiment shown in FIG. 1 along lines 3-3.

A preferred embodiment of the present invention is shown in FIGS. 1-3. The golf club head 10, which in the preferred embodiment is a fairway wood head, includes a body 20 having a sole 30, a crown 40, a hose 50, a cavity 22, and a weight lip 80, and a face component 60 comprising a striking face 62, a return portion 64, and a cavity 66. The striking face 62 preferably has a high characteristic time (CT). The face component 60 preferably is integrally forged from a metal alloy such as 6-4 titanium or stainless steel, while the body 20 preferably is integrally cast from such alloys. In other embodiments, the face component 60 and body 20 may be constructed using different methods and with any materials commonly used for golf club manufacturing. In some embodiments, the face component 60 and body 20 may be integrally formed. The body 20 may further comprise another weighting element, such as a weight pad, a thickened wall area, or a removable weight screw (not shown) to allow a manufacturer or a golfer to adjust any remaining discretionary weight.

Once the body 20 and face component 60 are formed, they are welded together along the opening 25 at the front of the body 20. The weld seam 70, shown in FIG. 3, has a constant, relatively low thickness, preferably approximately 0.031 inch. In order to achieve a low, frontward CG without affecting the weld seam 70, the weight lip 80 is located inside the cavity 22 and proximate the opening 25. This construction avoids creating welding problems, but still allows for discretionary mass to be located mostly low and forward in the golf club head.

The weight lip 80, which preferably is cast into the body 20 but may, in alternative embodiments, be welded or affixed mechanically to the body 20, extends upwards from the sole 30 and protrudes from the opening 25 of the body 20. When the golf club head 10 is assembled, the weight lip 80 extends into the cavity 66 of the face component 60 without making contact with the striking face 62. The weight lip 80 preferably comprises at least 20% of the mass of the body 20, and more preferably 30% of the mass of the body. For example, the golf club head 10 may have the weight distribution shown in Table 1.

TABLE I

| Club Part | Weight (in grams) |
|---|---|
| Body 20 | 167 |
| Weight lip 80 | 49 |
| Face component 60 | 38 |
| Total Golf Club Head 10 Weight | 205 |

From the foregoing it is believed that those skilled in the pertinent art will recognize the meritorious advancement of this invention and will readily understand that while the present invention has been described in association with a preferred embodiment thereof and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A wood-type golf club head comprising:

a body comprising a crown, a sole, a hosel, a cavity, a frontal opening, and a protrusion; and a face component comprising a striking face covering the frontal opening, wherein the protrusion is located within the cavity proximate the frontal opening and extends upwards from the sole and towards the face component without touching the striking face, and wherein the protrusion extends from a heel side of the body to a toe side of the body and does not comprise any hollow regions.

2. The wood-type golf club head of claim 1, wherein the body is composed of a first metal material.

3. The wood-type golf club head of claim 2, wherein the face component is composed of a second metal material that has a different density than the first metal material.

4. The wood-type golf club head of claim 1, wherein the body is forged.

5. The wood-type golf club head of claim 1, wherein the body is cast.

6. The wood-type golf club head of claim 1, wherein the striking face has variable thickness.

7. The wood-type golf club head of claim 1, wherein the striking face has a constant thickness.

8. The wood-type golf club head of claim 1, wherein the face component is forged.

9. The wood-type golf club head of claim 1, wherein the face component is cast.

10. The wood-type golf club head of claim 1, wherein the body and the face component are integrally cast.

11. The wood-type golf club head of claim 1, wherein the face component is welded to the body.

12. The wood-type golf club head of claim 11, further comprising a weld seam having a constant thickness.

13. The wood-type golf club head of claim 12, wherein the weld seam has a thickness of approximately 0.031 inch.

14. The wood-type golf club head of claim 1, wherein the protrusion comprises at least 20% of the mass of the body.

15. The wood-type golf club head of claim 1, wherein the golf club head has a volume of no less than 120 cubic centimeters and no more than 300 cubic centimeters.

16. The wood-type golf club head of claim 1, further comprising a weight pad, wherein the weight pad is affixed to the sole.

17. The wood-type golf club head of claim 1, further comprising a removable weight screw.

18. The wood-type golf club head of claim 1, further comprising a thickened wall area proximate the protrusion.

19. The wood-type golf club head of claim 1, wherein the protrusion is mechanically affixed to the sole.

20. The wood-type golf club head of claim 1, wherein the protrusion is integrally formed with the sole.

* * * * *